US008047867B2

(12) United States Patent
Wu

(10) Patent No.: US 8,047,867 B2
(45) Date of Patent: Nov. 1, 2011

(54) CONNECTING ASSEMBLY FOR CONNECTING ELECTRIC CONNECTOR AND CONTROL BOX

(75) Inventor: Chou-Hsin Wu, Xindian (TW)

(73) Assignee: T-Motion Technology Co. Ltd., Taipei (TW)

( * ) Notice: Subject to any disclaimer, the term of this patent is extended or adjusted under 35 U.S.C. 154(b) by 516 days.

(21) Appl. No.: 12/352,003

(22) Filed: Jan. 12, 2009

(65) Prior Publication Data

US 2010/0178793 A1 Jul. 15, 2010

(30) Foreign Application Priority Data

Mar. 19, 2008 (TW) ..... 97204707 U

(51) Int. Cl.
*H01R 1/00* (2006.01)

(52) U.S. Cl. ..... 439/517

(58) Field of Classification Search ..... 439/517, 439/345, 347

See application file for complete search history.

(56) References Cited

U.S. PATENT DOCUMENTS

| | | | | |
|---|---|---|---|---|
| 3,601,858 | A * | 8/1971 | Blanchard | 425/86 |
| 5,104,294 | A * | 4/1992 | Banba | 417/36 |
| 6,019,950 | A * | 2/2000 | Lai | 422/186.12 |
| 7,008,530 | B2 * | 3/2006 | Stocchiero et al. | 210/143 |
| 2007/0086908 | A1 * | 4/2007 | Faccio et al. | 418/201.1 |

* cited by examiner

*Primary Examiner* — Gary F. Paumen

(74) *Attorney, Agent, or Firm* — Chun-Ming Shih; HDLS IPR Services

(57) ABSTRACT

A connecting assembly for an electric cylinder and a control box includes an electric cylinder, an electric control box and a sheathing ring. The electric cylinder includes an actuator and a contractible pipe module perpendicularly connected to an end of the actuator. The electric control box is disposed on an internal side at a right-angled position with respect to the actuator and the contractible pipe module and slidably connected to a side of the actuator. The sheathing ring is sheathed onto a contractible pipe module and slidably connected to a side of the electric control box. The connecting assembly of the invention not only achieves a screwless application, but also provides a quick, simple, convenient and stable assembling process.

8 Claims, 4 Drawing Sheets

CONNECTING ASSEMBLY FOR CONNECTING ELECTRIC CONNECTOR AND CONTROL BOX

BACKGROUND OF THE INVENTION

1. Field of the Invention

The present invention generally relates to a connecting assembly, and more particularly to a connecting assembly for connecting an electric cylinder and a control box of a medical bed.

2. Description of Prior Art

An electric cylinder or an actuator applied to an electric equipment such as a medical bed, a facial bed or a massaging chair not only improves the convenience of use, but also enhances the add-on value of the electric equipment, and applications of these electric equipments generally require a plurality of electric cylinders connected to an electric control box and an operation controller separately, and the operation controller is provided for controlling operations of each electric cylinder, such that a front section, a middle section and a rear section of the medical bed can be ascended or descended. To achieve an appropriate simplified effect and an integral aesthetic appearance, manufacturers usually combine the electric cylinder with the electric control box for installing each electric cylinder and the electric control box to the electric equipment.

A conventional connecting assembly for connecting an electric cylinder and a control box comprises an electric cylinder and an electric control box, wherein the electric cylinder comprises an actuator and a contractible pipe module connected to an end of the actuator, and a protrusion is formed on the electric control box and disposed at a position corresponding to a side of the actuator, and the actuator has an embedding slot disposed at a position corresponding to the protrusion. In an assembling process, the protrusion is embedded into the embedding slot, such that the electric control box is connected onto the electric cylinder, and then a screw is passed through the contractible pipe module and secured to the electric control box for assembling the connecting assembly for connecting an electric cylinder and a control box.

However, it is necessary to use a tool such as a screwdriver to secure the screws during the assembling process of the conventional connecting assembly for connecting an electric cylinder and a control box, and thus the conventional connecting assembly not only has the drawback of a slow assembling rate, but also requires a screwdriver or another tool to loosen the screws before opening the connecting assembly. Obviously, this arrangement makes the application of the connecting assembly inconvenient and the prior art requires improvements.

SUMMARY OF THE INVENTION

It is a primary objective of the present invention to provide a connecting assembly for connecting an electric cylinder and a control box, wherein a slide connecting mechanism is installed among components, so that it is not necessary use a tool for the assembling process, and the invention can provide a quick, simple, and convenient way of connecting components in the assembling process.

To achieve the foregoing objective, the present invention provides a connecting assembly for connecting an electric cylinder and a control box, and the assembly comprises an electric cylinder, an electric control box and a sheathing ring, wherein the electric cylinder comprises an actuator and a contractible pipe module perpendicularly connected to an end of the actuator, and the electric control box is installed at a right-angled position with respect to the actuator and the contractible pipe module, and slidably connected to a side of the actuator, and the sheathing ring is sheathed onto the contractible pipe module and slidably connected to an side of the electric control box.

Another objective of the present invention is to provide a connecting assembly for connecting an electric cylinder and a control box, and the assembly further comprises a stop plate formed on a slide cover for pressing a distal surface of the sheathing ring to improve the stability of fixing the sheathing ring axially.

A further objective of the present invention is to provide a connecting assembly for connecting an electric cylinder and a control box, and the assembly does not require using any tool during the process of assembling, replacing and repairing components to enhance the convenience of use.

Another objective of the present invention is to provide a connecting assembly for connecting an electric cylinder and a control box, and the assembly does not require using any screw, so as to save the material and manufacturing costs.

DETAILED DESCRIPTION OF THE INVENTION

The technical characteristics, features and advantages of the present invention will become apparent in the following detailed description of preferred embodiments with reference to the accompanying drawings, and the preferred embodiments are used for illustrating the present invention only, but not intended to limit the scope of the invention.

Figure 1:
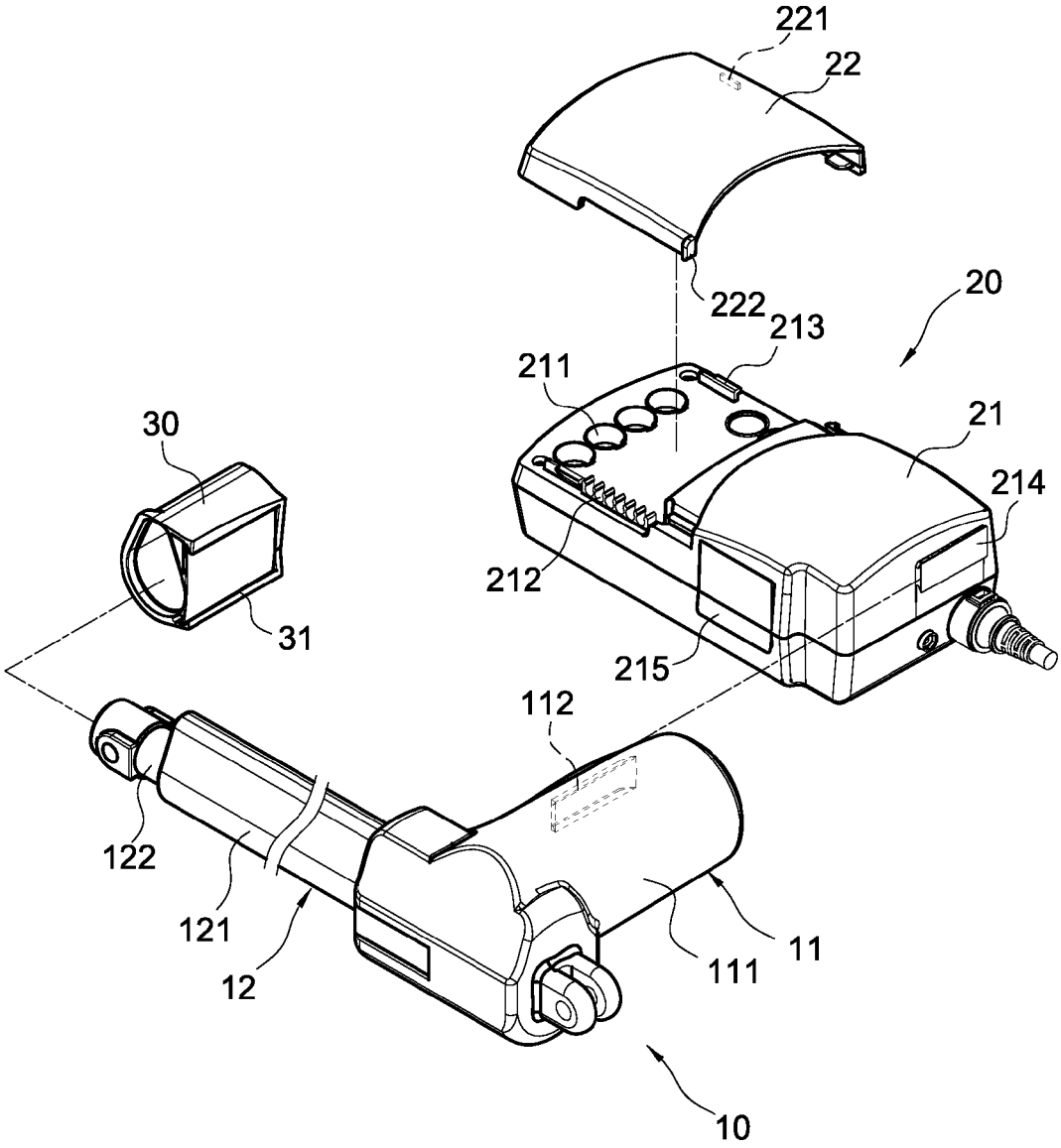
FIG. 1 is an exploded view of a connecting assembly in accordance with the invention.
Figure 2:
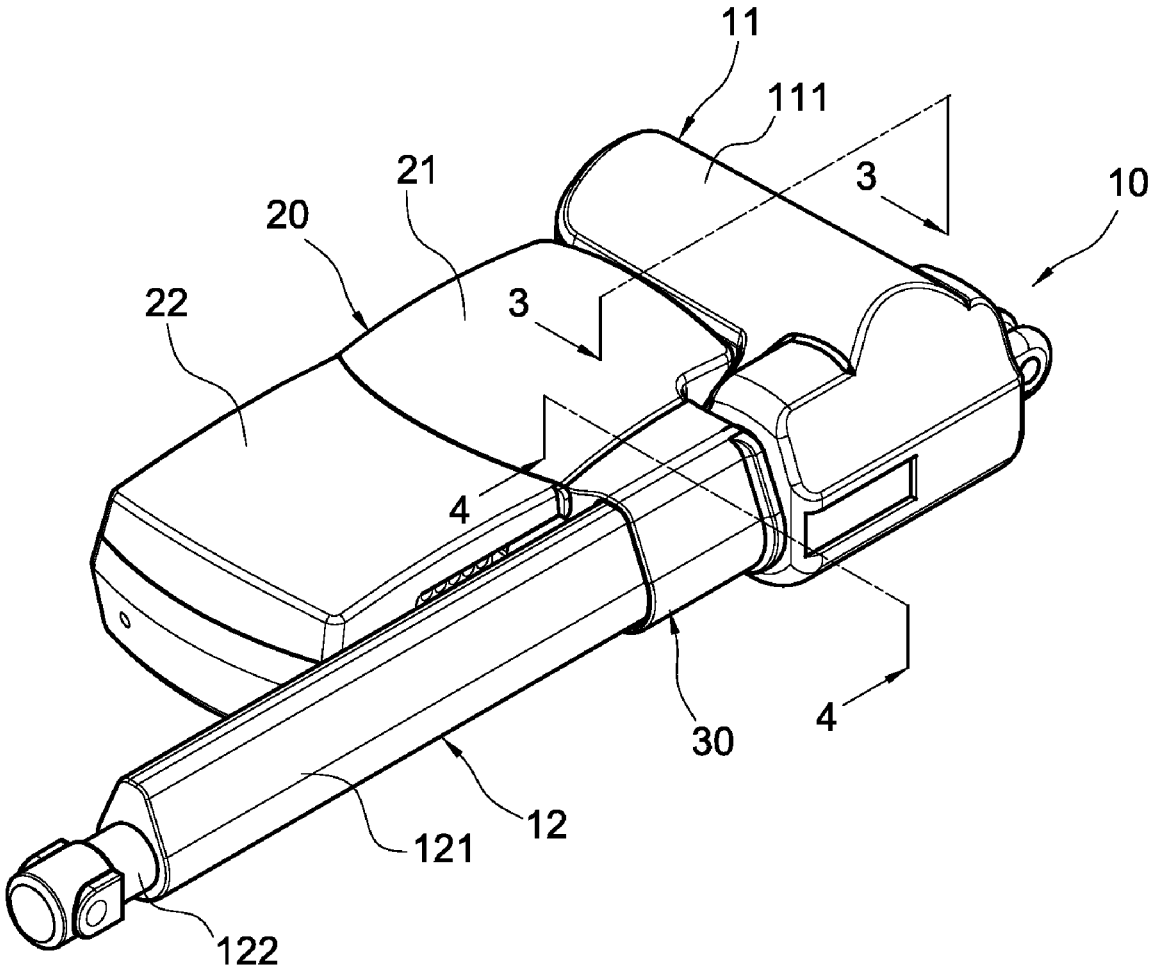
FIG. 2 is a perspective view of a connecting assembly in accordance with the invention.
Figure 3:
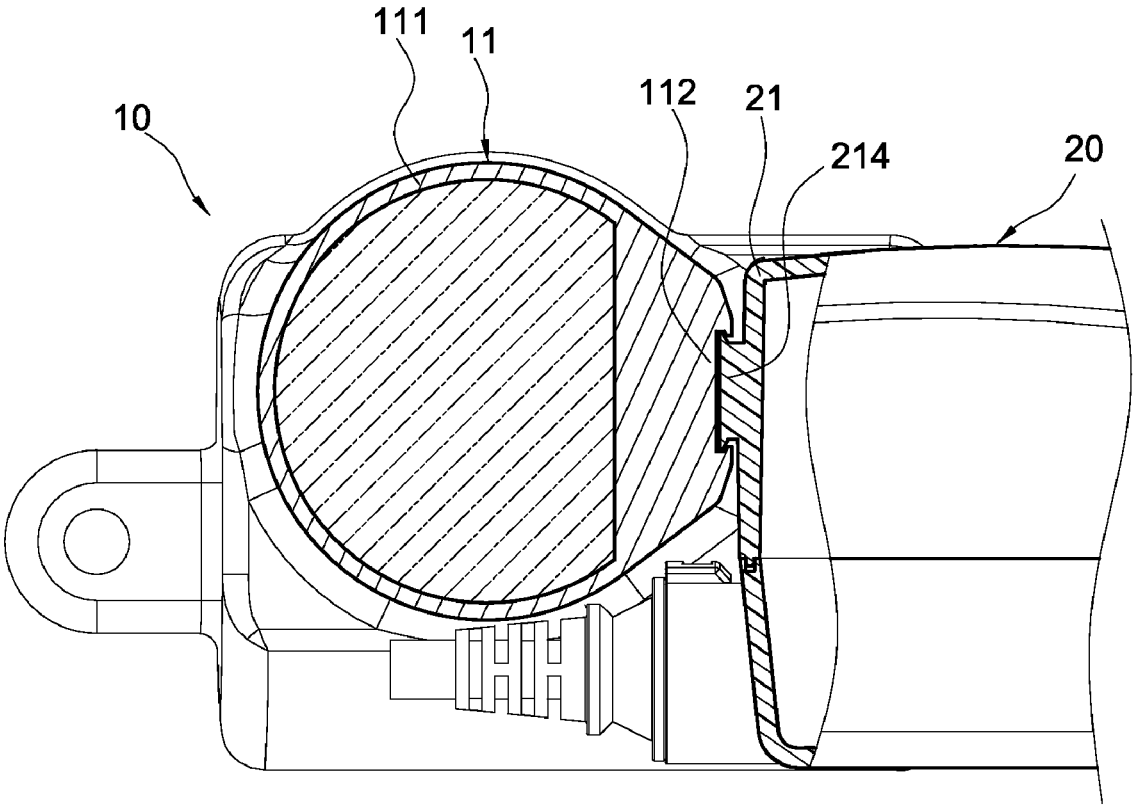
FIG. 3 is a cross-sectional view of Section 3-3 as depicted in FIG. 2.
Figure 4:
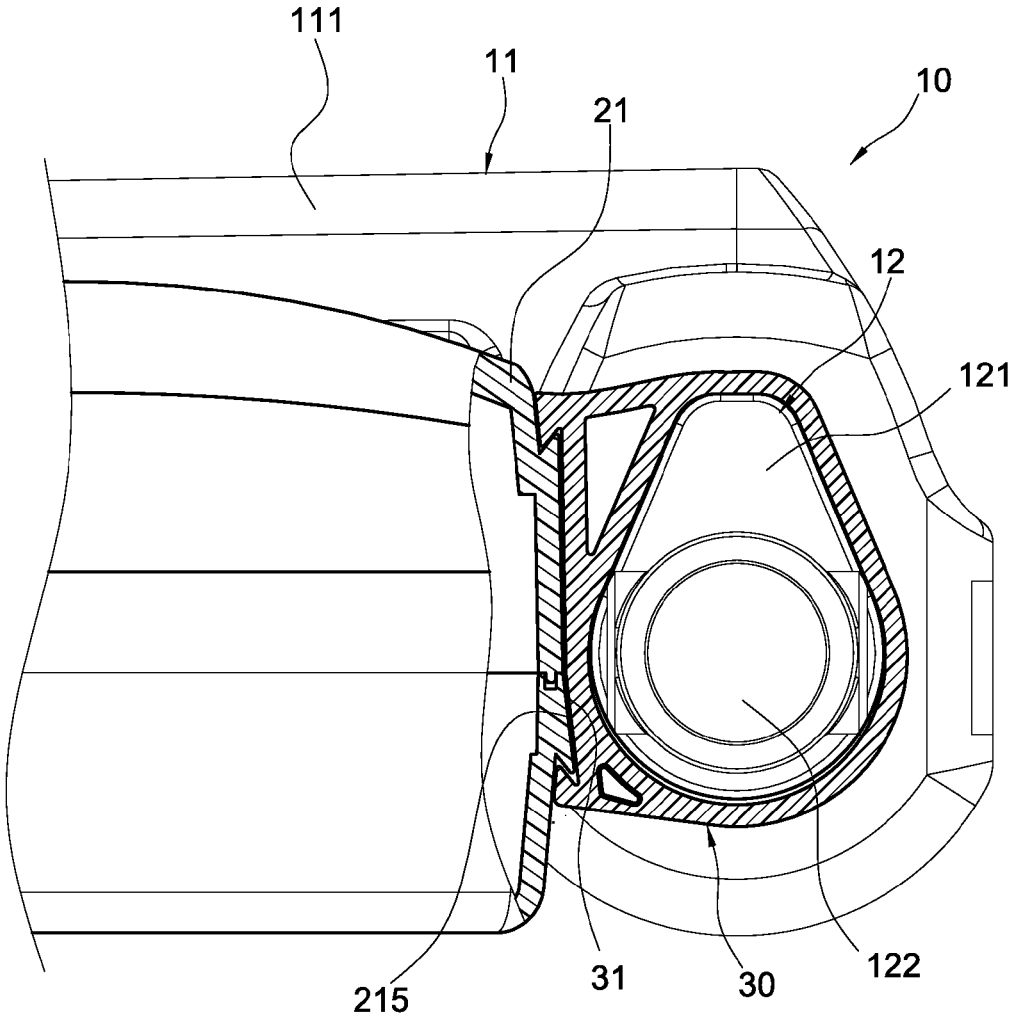
FIG. 4 is a cross-sectional view of Section 4-4 as depicted in FIG. 2

With reference to FIGS. 1 to 4 for an exploded view and a perspective view of a connecting assembly in accordance with the present invention, and cross-sectional views of Sections 3-3 and 4-4 as depicted in FIG. 2 respectively, the connecting assembly for connecting an electric cylinder and a control box comprises an electric cylinder 10, an electric control box 20 and a sheathing ring 30.

The electric cylinder 10 comprises an actuator 11 and a contractible pipe module 12, and the actuator 11 is comprised of a motor (not shown in the figure) and a circular casing 111 covered onto the exterior of the motor, and a first embedding slot 112 is disposed at an internal side of the casing 111. In this embodiment, the first embedding slot 112 is substantially dove-tail shaped but not limited to such arrangement only, and any other geometric shape can be adopted. The contractible pipe module 12 is perpendicularly connected to an end of the actuator 11 and also connected with the aforementioned motor and a fixed base (not shown in the figure) covered by the casing 111. An external pipe 121 is connected to an end of the fixed base and partially covered by the casing 111, and a contractible pipe 122 is contained in an external pipe 121 and moved linearly with respect to the external pipe 121.

The electric control box 20 is a dove-tail body installed at a right-angled position with respect to the actuator 11 and the contractible pipe module 12. The electric control box 20 includes a hollow box body 21 and a slide cover 22, and the box body 21 is comprised of upper and lower box panels and includes a plurality of through grooves 211 for fixing a plurality of connectors (not shown in the figure), and a plurality of wiring ducts 212 are disposed at the front side of the through grooves 211 for installing and connecting electric wires (not shown in the figure) of the connectors, and a hook 213 is formed at the rear side of the through grooves 211. A first guiding block 214 is formed on the box body 21 and disposed at a position corresponding to a side of the casing 111, and the first guiding block 214 is substantially dove-tail shaped and slidably coupled to the first embedding slot 112.

Further, a second guiding block 215 is formed on the box body 21 and disposed at a position corresponding to a side of the contractible pipe module 12, and the second guiding block 215 is also substantially dove-tail shaped. The slide cover 22 is slidably coupled to the top of the box body 21 and includes a latch slot 221 corresponding to the hook 213 for latching with each other. A stop plate 222 is protruded from the slide cover 22 and disposed proximate to a side of the contractible pipe module 12.

The sheathing ring 30 is a hollow ring body sheathed onto an external pipe 121 of the contractible pipe module 12 and pressed against the casing 111, and a second embedding slot 31 is formed on the sheathing ring 30 and disposed towards a side of the electric control box 20. In this embodiment, the second embedding slot 31 is also substantially dove-tail shaped and slidably coupled to the second guiding block 215. The sheathing ring 30 is stacked and connected to a rear distal surface of the casing 111 with a height not exceeding the position of the stop plate 222 connected to the slide cover 22, such that when the slide cover 22 is latched with the hook 213 of the box body 21 by the latch slot 221, the stop plate 222 can be abutted against the distal surface of the sheathing ring 30 (as shown in FIG. 2) to achieve the effect of fixing the sheathing ring 30 axially.

In the assembling process, upper and lower box panels are installed to form the box body 21 first, and then the first guiding block 214 of the box body 21 is slidably coupled to the first embedding slot 112 of the electric cylinder 10, and the sheathing ring 30 is sheathed onto the external pipe 121 of the contractible pipe module 12 and pushed axially towards the external pipe 121, and the second embedding slot 31 of the sheathing ring 30 is slidably coupled onto the first guiding block 215 of the box body 21, and the front distal surface of the sheathing ring 30 is attached with the casing 111, and finally the slide cover 22 is slidably coupled to the box body 21, and the hook 213 of the box body 21 is latched and fixed into the latch slot 221 of the slide cover 22. In the meantime, the stop plate 222 of the slide cover 22 is abutted precisely at the rear distal surface of the sheathing ring 30, such that a secured connection is constituted among the electric cylinder 10, box body 21, slide cover 22 and sheathing ring 30.

In summation of the description above, the connecting assembly for connecting an electric cylinder and a control box in accordance with the present invention complies with the patent application requirements, and is duly filed for patent application. While the invention has been described by means of specific embodiments, numerous modifications and variations could be made thereto by those skilled in the art without departing from the scope and spirit of the invention set forth in the claims.

What is claimed is:

1. A connecting assembly for an electric cylinder and a control box, comprising:

an electric cylinder, including an actuator and a contractible pipe module perpendicularly coupled to an end of the actuator;

an electric control box, installed at a right-angled position with respect to the actuator and the contractible pipe module, and slidably coupled to a side of the actuator; and a sheathing ring, sheathed onto the contractible pipe module, and slidably coupled to a side of the electric control box.

2. The connecting assembly for an electric cylinder and a control box of claim 1, wherein the actuator comprises a casing, and a first embedding slot disposed on an internal side of the casing, and the electric control box comprises a hollow box body, a first guiding block formed on a side of the box body corresponding to the casing, and the first guiding block and the first embedding slot are slidably coupled with each other.

3. The connecting assembly for an electric cylinder and a control box of claim 2, wherein the first embedding slot and the first guiding block are substantially dove-tail shaped.

4. The connecting assembly for an electric cylinder and a control box of claim 2, wherein the electric control box further comprises a slide cover slidably coupled onto the box body, a latch slot disposed on the slide cover, and a hook disposed on the box body and corresponding to the latch slot, and the hook and the latch slot are latched with each other.

5. The connecting assembly for an electric cylinder and a control box of claim 4, wherein the slide cover includes a stop plate formed on a side of the slide cover and at a position proximate to the contractible pipe module, and the sheathing ring is stacked and coupled to a distal surface of the casing with a height not exceeding the position of the slide cover connected to the stop plate, such that the stop plate can abut and fix the distal surface of the sheathing ring.

6. The connecting assembly for an electric cylinder and a control box of claim 1, wherein the contractible pipe module comprises an external pipe, and the sheathing ring is sheathed onto the external pipe.

7. The connecting assembly for an electric cylinder and a control box of claim 6, wherein the sheathing ring includes a second embedding slot formed on a side of the sheathing ring, and the electric control box includes a hollow box body, and a second guiding block formed on a side of the box body and corresponding to the sheathing ring, and the second guiding block and the second embedding slot are slidably coupled with each other.

8. The connecting assembly for an electric cylinder and a control box of claim 7, wherein the second embedding slot and the second guiding block are substantially dove-tail shaped.

* * * * *